United States Patent [19]

Tuckey et al.

[11] 4,139,580

[45] Feb. 13, 1979

[54] SELF-LIFT CARBURETOR

[75] Inventors: Charles H. Tuckey; David M. Asher, both of Cass City, Mich.

[73] Assignee: Walbro Corporation, Cass City, Mich.

[21] Appl. No.: 796,614

[22] Filed: May 13, 1977

[51] Int. Cl.[2] ..... F02M 17/04

[52] U.S. Cl. ..... 261/35; 261/DIG. 68; 261/69 A

[58] Field of Search ..... 261/DIG. 68, 69 A, 35

[56] References Cited

U.S. PATENT DOCUMENTS

| | | | |
|---|---|---|---|
| 1,804,659 | 5/1931 | Tice | 261/69 A |
| 2,396,031 | 3/1946 | Udale et al. | 261/69 A |
| 3,104,617 | 9/1963 | Barr | 261/35 |
| 3,151,627 | 10/1964 | Rice | 261/DIG. 68 |
| 3,241,822 | 3/1966 | Degenhardt | 261/DIG. 68 |
| 3,253,822 | 5/1966 | Arndt et al. | 261/DIG. 68 |
| 3,253,822 | 5/1966 | Arndt et al. | 261/35 |
| 3,254,880 | 6/1966 | Phillips | 261/DIG. 68 |
| 3,256,869 | 6/1966 | Nutten et al. | 261/DIG. 68 |
| 3,738,623 | 7/1973 | Tuckey | 261/DIG. 68 |

*Primary Examiner*—Tim R. Miles

*Attorney, Agent, or Firm*—Barnes, Kisselle, Raisch & Choate

[57] ABSTRACT

A small carburetor for chain saws and the like which needs no fuel pump. A spring-biased diaphragm has a radically higher bias than is normal and controls a fuel inlet valve open to the tank such that a higher vacuum is needed to open the valve, thus providing the necessary pull to draw fuel from a tank in any position relative to the fuel tank whether below, above, or to the side of the carburetor. An on-off check valve is interposed between the diaphragm fuel chamber and the main fuel orifice to insure constant negative pressures in the diaphragm chamber. The carburetor body, molded from plastic, has a composite jet insert and plug-in connection to the engine.

7 Claims, 9 Drawing Figures

SELF-LIFT CARBURETOR

This invention relates to a Self-Lift Carburetor and more particularly to a carburetor for use with small utilities such as chain saws.

BACKGROUND OF INVENTION

There has been, in the field of commercial carburetors, a struggle for smaller and smaller designs and lower and lower cost. When used in conjunction with internal combustion engines to power chain saws, small generators, and the like, the manufacturers have been competing with each other to reduce the size and weight of the overall structures. Thus, there has been pressure on the manufacturers of carburetors to decrease size, weight, and cost of the carburetors furnished.

The present invention is a product of this need to provide a small, inexpensive, lightweight carburetor. It is an object, therefore, to disclose a carburetor having a plastic body and which requires no fuel pump. The carburetor can be designated a self-lift carburetor which will draw fuel directly from a fuel tank without the aid of a pump and which will operate in any position relative to the fuel tank. This is sometimes referred to as an "all-position" carburetor.

Basic self-lift carburetors have been used in the early stages of power mowers, but the present design is for use with an all-position carburetor and the sophisticated design is believed to be the first self-lift unit to be adapted to this use.

Basically, the invention requires the use of a greatly increased diaphragm control valve spring rate and a venturi to create enough vacuum (signal) to overcome the spring to cause the fuel to flow into the carburetor, thereby eliminating the need for a fuel pump. In addition, an on-off check valve is interposed in the outlet of a diaphragm chamber to eliminate backflow of air into the metering chamber.

A further object of the invention relates to the use of a molded plastic carburetor body which eliminates machining and which incorporates some inserts to provide the necessary jets, fuel chambers and passages for full or partial throttle operation and for idling.

Other objects and features of the invention will be apparent in the following disclosure in which the invention is described in connection with details to enable a person skilled in the art to make and use the invention, all in connection with the best mode presently contemplated for the practice of the invention.

BRIEF DESCRIPTION OF DRAWINGS

Drawings accompany the disclosure and the various views thereof may be briefly described as.

The basic concept to be diclosed is the use of the power head, that is, the engine, and particularly the piston of the engine as the source of pumping action to bring fuel to the carburetor. The carburetor is, of course, positioned between the engine and the fuel tank and, in essence, the carburetor is a highly refined metering device to supply a proper fuel and air mixture to the engine.

There are six basic functioning parts:

1. The carburetor body which has formed in it a restricted flow passage (venturi) to increase air speed through the mixing passage into the engine and create negative pressures needed to lift fuel.

2. An adjustable air valve (throttle valve) to control air fuel flow into the engine, thus controlling the engine speed.

3. A positive "on-off" check valve which has a vital function as will be described.

4. A metering jet to control the amount of liquid fuel passed to the mixing passage.

5. A fuel reservoir lift chamber (metering chamber) for a ready supply of fuel to the metering jet.

6. A pressure sensitive fuel inlet system which will maintain a constant negative pressure to control fuel lift and consistent metering.

These basic parts will be described in detail in connection with the drawings.

DETAILS OF FIRST EMBODIMENT

Figure 2:
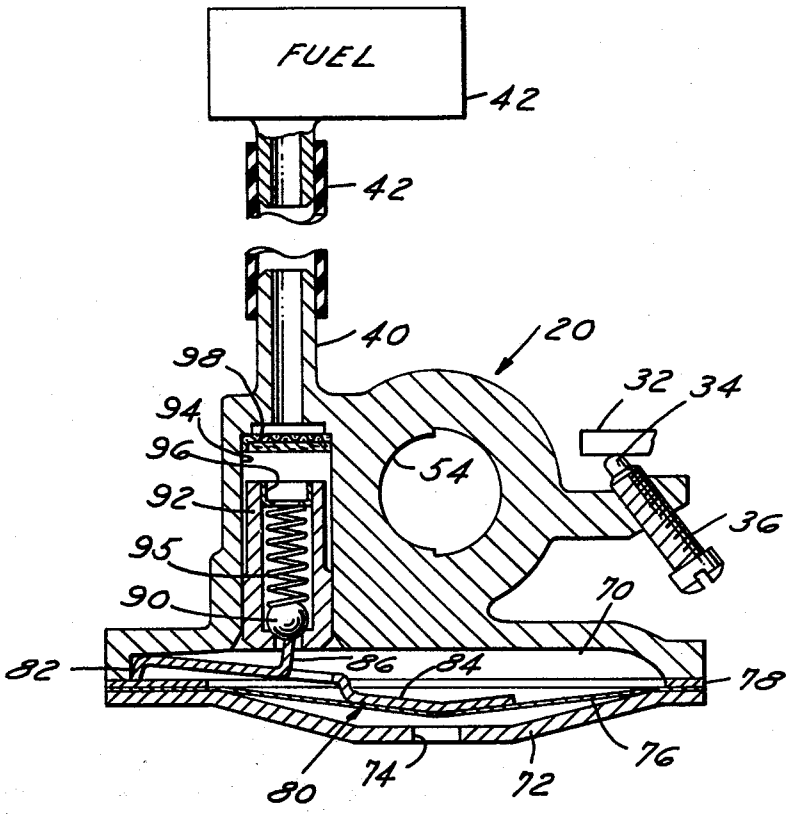
FIG. 2, a section on line 2—2 of FIG. 1.
Figure 1:
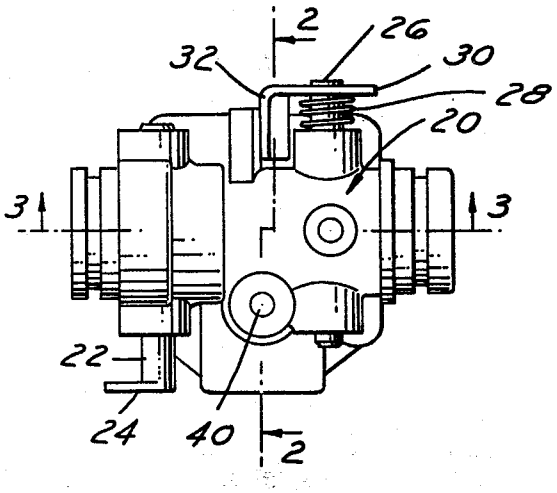
FIG. 1, a top view of a carburetor assembly.

With reference to the drawings, in FIG. 1, a carburetor body 20 is shown having a choke operating shaft 22 and lever 24, and a throttle valve shaft 26, with a return spring 28, and an L-shaped operating lever 30 which has one leg 32 overlying the end 34 of an adjustable screw 36 (FIG. 2). A fuel inlet tube 40 projects upwardly from the body 20 to connect to a fuel tank tube 42 of a fuel tank as illustrated in FIG. 2.

Figure 3:
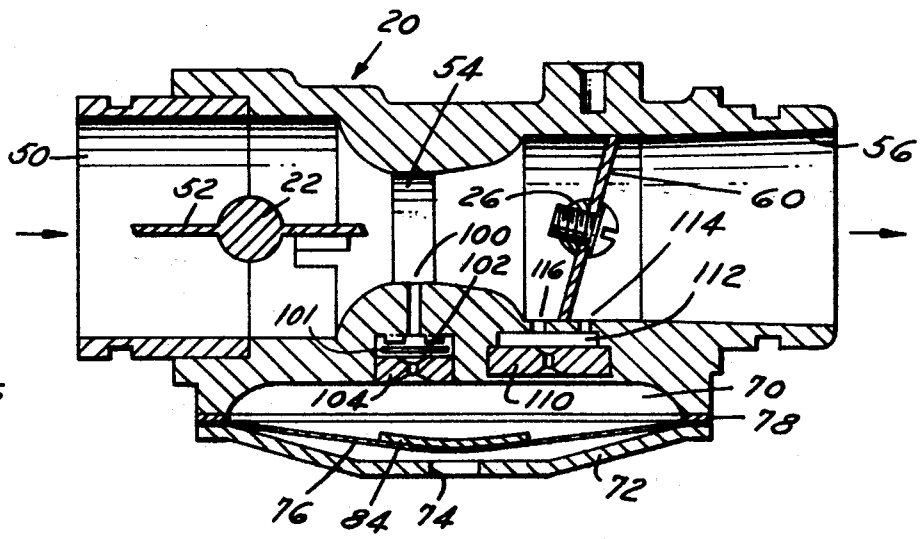
FIG. 3, a section on line 3—3 of FIG. 1.

The body 20 has a fuel and air passage extending therethrough as shown in FIGS. 2 and 3. This passage, sometimes called a mixing passage, has an air entry 50 in which a choke valve 52 is located, a restricted passage 54, commonly called a venturi, and an engine or outlet passage 56, controlled by throttle valve 60, for fuel and air mixture. The choke valve 52 is molded integrally with the shaft 22 and retained in position by the air horn or by a filter assembly.

Below the main body of the carburetor, and on the bottom surface is formed a fuel chamber 70 closed by a dished disc 72 having a central vent opening 74. A flexible diaphragm 76 underlies the chamber 70, the periphery of the diaphragm being sealed along with a circular gasket 78 between the peripheries of the main body 20 and the cover plate 72.

A lever 80, FIG. 2, is pivoted at a heel portion 82 at the outside of chamber 70 and has an offset portion 84 dished to lie against a central area of the diaphragm 76. A struck-out tab 86 projects upwardly to contact a spring-backed ball valve 90 which seats in a valve seat at the bottom of a cup insert 92 frictionally secured in a well 94 below fuel inlet 40. The spring 95 is backed up an apertured plug 96 fitted into cup 92. A filter disc 98 is disposed across the top of the well 94.

Looking at the longitudinal cross-section of the carburetor in FIG. 3 the main fuel and idle jets are illustrated above the fuel chamber 70. The main fuel orifice or port 100 enters the mixing passage at the venturi portion 54 and below this port is a recess 101 containing a disc check valve 102 retained by the main jet plug 104. The disc valve 102 seats against the plug 104 to prevent backflow during the idle phase of operation and for other reasons to be set forth, but this valve allows flow through the port 100 into the mixing passage because the surface above it in the body 20 is slotted. It is preferred that a small coil spring (not shown) be used to back the valve disc 102. The idle system of the carburetor above described is shown in FIG. 3 having a plug idle jet 110 below a chamber 112 which opens to the mixing passage through an idle port 114 and a progression port 116. In some instances it may be desirable to connect chamber 112 with the chamber 101 above plug 104 and to close the plug 110.

THE OPERATION

Figure 4:
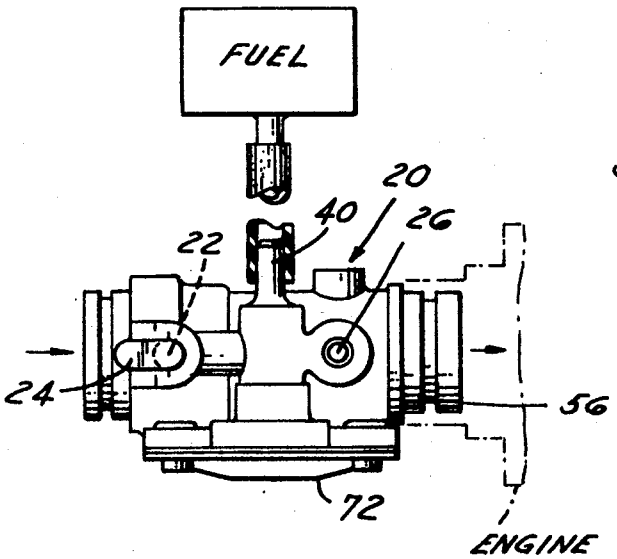
FIG. 4, a side view of the carburetor body.
Figure 6:
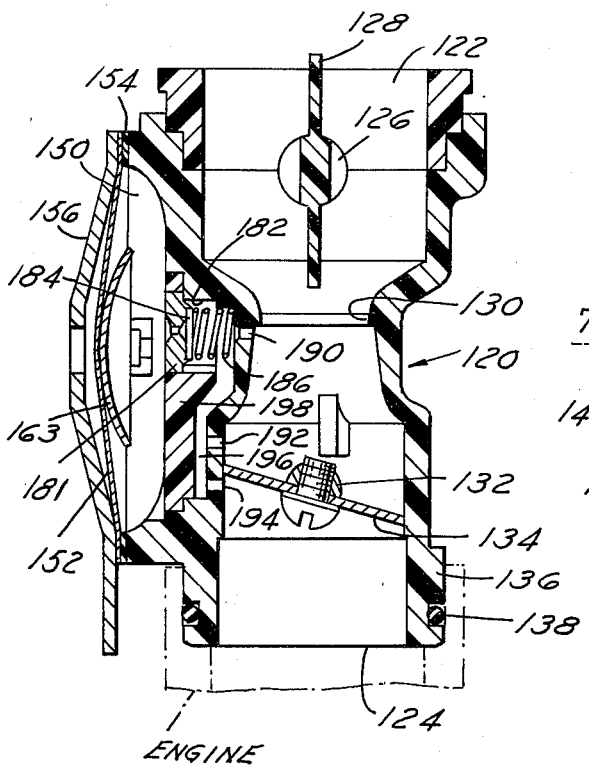
FIG. 6, a section on line 6—6 of FIG. 5.

The carburetor is mounted directly to the engine at the intake port opening of, for example, a two-cycle engine. The fuel tank in the upright position of the assembly is above the carburetor as shown in FIGS. 2 and 4. The engine serves as a fuel pump as the piston reciprocates and the two-way pulse of the piston is converted into a one-way pulse by the carburetor to pull fuel to the fuel reservoir or metering chamber 70. This is accomplished by the coordination of the fuel inlet system and the check valve 102.

As the piston of the engine reciprocates, a vacuum pulse is created. It is, therefore, feasible to use this pulse to create a pumping action for the fuel, thus eliminating the need for a separate diaphragm pump which has been built into the main body of most diaphragm carburetors. Piston port engines are designed so that the intake flow is of longer duration than the backflow. If this were not the case, there would be as much fuel going out of the engine as into the engine.

When the intake pulse is created, it lifts the check valve 102 off the jet plug 104 exposing the metering chamber 70 to the full effectiveness of the intake vacuum pulse. This lowers the pressure in the metering chamber; and when this pressure drop is great enough, it will cause the diaphragm 76 to lift, thus lifting the lever 84 and causing the tab 86 to open the spring pressure ball check 90. The amount of pressure drop needed to open the inlet valve is controlled by the rating of the spring 95 and this can be raised or lowered according to the fuel lift requirement. Preferably, this spring rating is such that it would pull a column of 9" of water, whereas the normal diaphragm pull for a fuel inlet is ¼ to 1" of water. While the spring rating may vary to create a pull of 4 to 12" of water, it is always radically higher than the diaphragm pull of standard diaphragm carburetors.

When the valve 90 is open, the fuel can then enter from the fuel inlet 40 to fill the metering chamber, and it is free to pass through the metered jet plug 104 into the venturi area to be mixed with air for combustion. When the piston in the engine produces a back pulse, it closes the check valve 102, thus blocking the positive pressures from the metering chamber.

In order for a self-lift carburetor to run in all positions, a large negative pressure drop must be maintained in the metering chamber. For example, if the carburetor is located approximately 4" from the fuel supply and is in a position above the fuel supply, it must be possible to lift this fuel to at least the height of the carburetor, that is, to say that the metering chamber negative pressure drop must be high enough to pull fuel from the tank into the carburetor. This is calculated by the maximum distance the carburetor is from the tank, plus the amount of negative pressure needed to actually pull fuel from the tank. This may depend to some degree on tank venting. As the negative pressure in the metering chamber increases, the check valve sealing becomes an important factor. In a standard pump-assisted diaphragm carburetor, the metering chamber pressure is very near atmospheric or, as pointed out above, may be sufficient to pull ¼ to 1" of water.

In the carburetor with the present invention, negative pressure can average between 8 and 9" of water in a particular application. With this negative pressure existing in the metering chamber, a positive seal must occur in the check valve area. In the absence of this positive seal at the check valve, back pulses from the engine or any amount of atmospheric air can interrupt the consistency of the metering chamber pressure which is directly related to the amount of fuel flow. Therefore, an uneven running condition will exist as fuel flows vary along with metering pressures. Thus, the positive on-off check valve is an important feature of the present invention.

It is desirable then to have a spring assist to the check valve. This spring is not shown in FIGS. 1 to 4 but is illustrated in the embodiment shown in FIGS. 5 to 9. This spring assist to the check valve is calibrated to close the check valve disc before the back pulse or atmospheric air can enter the metering chamber. If this metering chamber pressure varies, it will be most noticeable during idle conditions because all engine pulses are primarily channeled into the idle discharge passage where their effect is directed to the check valve area. Fuel flows are low under idle conditions and slight variations can alter engine r.p.m. considerably.

With the introduction of the positive on-off check valve, the idle circuit and the high speed circuit can be combined and fed by one single metering jet as will be illustrated in connection with the embodiment of FIGS. 5 to 9. Accordingly, balancing of air fuel ratio at idle can then be accomplished by varying the idle, progression, and nozzle discharge hole sizes along with the special metering jet. Without this positive check valve, this is impossible because an unbiased check valve shut-off is not positive or quick enough between vacuum or intake pulses. An added advantage of the on-off check valve is that the check valve is held in a normally closed condition on the venturi side of the jet. Under these conditions when the engine is shut off, the check valve immediately closes, thus preventing air leakage into the carburetor or fuel leakage out of the carburetor. Thus, an added safety factor is achieved.

To review the function of the on-off check valve, it can be stated again that if there is too much engine back pulse, it would vary the metering chamber pressure. With the biased check valve, the valve will always return to closed position regardless of pressure variations. Accordingly, the on-off check valve makes the difference in each case by closing the check valve disc or opening it under constant conditions, thus maintaining a constant metering chamber negative pressure which will maintain a constant fuel flow. This provides a consistent engine performance under all conditions and all positions of the engine.

DETAILS OF SECOND EMBODIMENT

Figure 5:
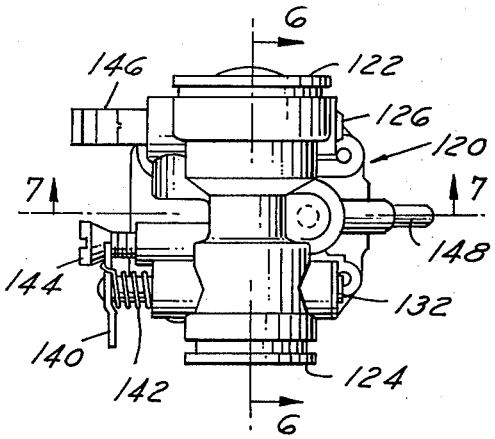
FIG. 5, a top view of a modified construction.
Figure 8:
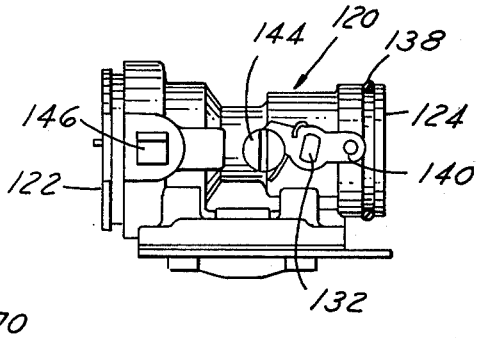
FIG. 8, a side view of the modified carburetor body.
Figure 7:
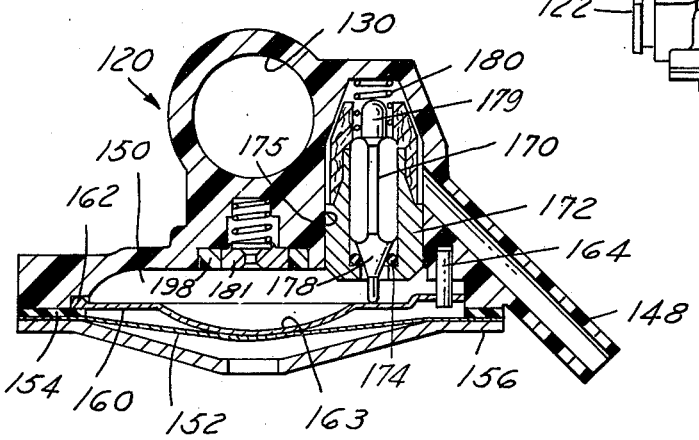
FIG. 7, a section on line 7—7 of FIG. 5.
Figure 9:
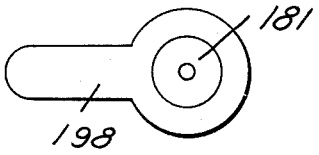
FIG. 9, a plan view of an insert for the jet and idle ports chamber.

In FIGS. 5 to 9, a second and preferred embodiment is illustrated. FIG. 5 shows the top of the carburetor body 120 with an air inlet 122 and a fuel mixture outlet 124. A choke shaft 126 and valve 128 (FIG. 6) is provided in the mixing passage having a venturi restriction 130 and a throttle shaft 132 and throttle valve 134. The neck portion 136 has a groove for an O-ring 138 to facilitate mounting on an engine. An operating lever 140 with a return spring 142 is provided for throttle shaft 132. A cone head screw 144 is adjustable to control the return position of the lever 140. On the end of the choke shaft 126 is a square projection 146 to facilitate operation of the choke shaft. A fuel supply tube 148 is formed on the body 120 for connection to a fuel tank.

On the bottom of the carburetor, a fuel chamber 150 is formed, closed by a diaphragm 152 held in place peripherally by a circular gasket 154 and a bottom plate 156 apertured centrally. A lever 160 fulcrummed at one end 162 in body 120 has a dished portion 163 which contacts the central area of the diaphragm. The other end of the lever is tabilized by a pin 164. Above one end of the lever is a fuel inlet valve 170 slidable in cup 172 having an O-ring seat 174 surrounding a fuel inlet opening to the fuel chamber 150. Cup 172 has a friction fit in a fuel inlet recess 175 and a filter is shaped around the open end of the cup. The needle type valve 170 slidable in the cup has a tapered portion 178 to cooperate with the O-ring 174, and a spring 180 seated around a tip 179 resiliently urges the valve to a closed position. Thus, the position of the diaphragm will control the lever 160 and the opening and closing of the valve 170.

A calibrated jet plug 181 is pressed into the bottom of a fuel well 182 having an orifice to receive fuel from chamber 150. An "on-off" disc check valve 184 above plug 181 is resiliently biased on the jet plug 180 by a spring 186. The fuel well 182 opens to the venturi 130 of the mixing passage through a jet port 190 and also connects to progression port 192 and idle port 194 through a passage 196.

The carburetor body 120 is preferably molded from a suitable plastic fully resistant to hydrocarbons and thus eliminates machining operations. The body has a key-hole recess molded above the fuel chamber 150 below ports 190, 192 and 194. The insert 181 with the fuel orifice is carried by an elongate plug element 198 shown in FIG. 9 which inserts into the key-hole recess to form the fuel well leading to port opening 190 and to form the idle passage 196 leading to ports 192 and 194. Thus, the carburetor ports, with the exception of cover plate 156 and the calibrated brass port insert 181, are all molded from plastic. The key-hole shaped plug 198 may be pressfitted into the recess provided for it, and sonic welded or cemented in place.

OPERATION OF SECOND EMBODIMENT

The embodiment of FIGS. 5 to 9 operates in the same manner as the first embodiment with the exception that the fuel jet in insert 187 provides the sole fuel supply to both the main discharge port 190 and the progression and idle ports 192 and 194. As pointed out, this has distinct advantages and leads to a simplified construction. The positive "on-off" valve 184 serves the same function as valve 102 of FIG. 3 but in this instance is preferably backed by a resilient member so that in the absence of an unbalancing pressure, it is in closed position. Thus spring 186, in the embodiment shown, preferably has a bias in a range of ½ to 4" (of water) breakaway range. The most practical rating from the point of view of manufacture is in the range of 3". Also in this embodiment, while the rating for spring 180 is preferably 8 or 9" of water, it may range from 4 to 12", many times higher than ratings usually used in diaphragm carburetors.

The carburetor may be below the fuel tank or above the tank or turned on its side in either direction and it will still function satisfactorily. Inversion of the device has been found to produce no detrimental effect on the operation.

While no needle valve controls are shown in the disclosed embodiments, these are standard items and may be added if desired for particular applications.

It will be appreciated that the fuel control inlet valves (90 in FIG. 2 and 170 in FIG. 7) are disposed so that they close and seat in the direction of fuel flow from the tank. Any unusual or abnormal pressure in the fuel tank will hold the valves closed. In normal operation, the fuel tanks must be vented to atmosphere. These valves may also serve as vibration governors where, at no load full throttle conditions on a chain saw, for example, the valves wil vibrate off the seat to allow influx of fuel and create an overrich mixture to prevent runaway and destructive speeds of an engine. For the needle valve 170, the tip angle is preferably 50° to 70° (included angle) to serve best as a noload speed control.

We claim:

1. In a self-lift, all-position carburetor to supply fuel from a fuel tank to an internal combustion engine which includes:

(a) a carburetor body having a venturi mixing passage with an inlet end and an outlet end and a main fuel port and idle fuel ports opening to said mixture passage, (b) a fuel chamber in said body open to said ports, (c) a diaphragm in said chamber responsive to engine pulses in said mixing passage, (d) an inlet valve for a fuel inlet in said body, (e) a lever actuated by said diaphragm to control the opening and closing of said inlet valve, that improvement which comprises:

(1) means to bias said diaphragm to a valve closing position having a calibration rating which requires negative pressures in the diaphragm chamber sufficient to lift fuel to the carburetor when the tank is below the carburetor and to open the inlet valve, and (2) an on-off check valve to allow flow to said ports from said diaphragm chamber and to block positive pulses into the diaphragm chamber, (f) said means to bias said diaphragm comprising resilient means calibrated to require a negative pressure of 4 to 12 inches of water to move the diaphragm and open the inlet valve.

2. In a self-lift, all-position carburetor to supply fuel from a fuel tank to an internal combustion engine which includes:

(a) a carburetor body having a venturi mixing passage with an inlet end and an outlet end and a main fuel port and idle fuel ports opening to said mixture passage, (b) a fuel chamber in said body open to said ports, (c) a diaphragm in said chamber responsive to engine pulses in said mixing passage, (d) an inlet valve for a fuel inlet in said body, (e) a lever actuated by said diaphragm to control the opening and closing of said inlet valve, that improvement which comprises:

(1) means to bias said diaphragm to a valve closing position having a calibration rating which requires negative pressures in the diaphragm chamber sufficient to lift fuel to the carburetor when the tank is below the carburetor and to open the inlet valve, and (2) an on-off check valve to allow flow to said ports from said diaphragm chamber and to block positive pulses into the diaphragm chamber, (f) said means to bias said diaphragm comprising resilient means calibrated to require a negative pressure of 4 to 12 inches to water to move the diaphragm and open the inlet valve, and (g) a second resilient means is provided to bias said on-off check valve to a closed position.

3. A self-lift, all-position carburetor as defined in claim 2 in which said second resilient means is calibrated to require a differential of ½ to 4" of water pressure to open the on-off valve.

4. In a self-lift, all-position carburetor to supply fuel from a fuel tank to an internal combustion engine which includes:

(a) a carburetor body having a venturi mixing passage with an inlet end and an outlet end and a main fuel port and idle fuel ports opening to said mixture passage, (b) a fuel chamber in said body open to said ports, (c) a diaphragm in said chamber responsive to engine pulses in said mixing passage, (d) an inlet valve for a fuel inlet in said body, (e) a lever actuated by said diaphragm to control the opening and closing of said inlet valve, that improvement which comprises:

(1) means to bias said diaphragm to a valve closing position having a calibration rating which requires negative pressures in the diaphragm chamber sufficient to lift fuel to the carburetor when the tank is below the carburetor and to open the inlet valve, and (2) an on-off check valve to allow flow to said ports from said diaphragm chamber and to block positive pulses into the diaphragm chamber, (f) said means to bias said diaphragm comprising resilient means calibrated to require a negative pressure of 4 to 12 inches of water to move the diaphragm and open the inlet valve, (g) a secondary supply chamber formed in said body adjacent and connecting said main and idle ports and open to said fuel chamber, and (h) an insert closure forming a barrier between said fuel chamber and said supply chamber, said closure having an opening forming a supply fuel orifice jet from said fuel chamber to said supply chamber.

5. A self-lift, all-position carburetor as defined in claim 4 in which said carburetor body and said insert closure are molded plastic parts.

6. A self-lift, all-position carburetor as defined in claim 4 in which said opening in said closure is controlled by said on-off check valve to connect reduced pressure in said mixing passage to said diaphragm chamber.

7. In a self-lift, all-position carburetor to supply fuel from a fuel tank to an internal combustion engine which includes:

(a) a carburetor body having a venturi mixing passage with an inlet end and an outlet end and a main fuel port and idle fuel ports opening to said mixture passage, (b) a fuel chamber in said body open to said ports, (c) a diaphragm in said chamber responsive to engine pulses in said mixing passage, (d) an inlet valve for a fuel inlet in said body, (e) a lever actuated by said diaphragm to control the opening and closing of said inlet valve, that improvement which comprises:

(1) means to bias said diaphragm to a valve closing position having a calibration rating which requires negative pressures in the diaphragm chamber sufficient to lift fuel to the carburetor when the tank is below the carburetor and to open the inlet valve, and (2) an on-off check valve to allow flow to said ports from said diaphragm chamber and to block positive pulses into the diaphragm chamber, (f) said means to bias said diaphragm comprising resilient means calibrated to require a negative pressure of 4 to 12 inches of water to move the diaphragm and open the inlet valve, (g) said inlet end of said carburetor body being formed as a cylindrical insert carrying an O-ring seal and insertable into a complementary mounting recess in an engine manifold.

* * * * *